United States Patent [19]

Noyes

[11] Patent Number: 4,688,868

[45] Date of Patent: Aug. 25, 1987

[54] GROUNDING GASKET FOR D-SHELL CONNECTOR

[75] Inventor: Robert W. Noyes, Framingham, Mass.

[73] Assignee: Honeywell Information Systems Inc., Waltham, Mass.

[21] Appl. No.: 863,204

[22] Filed: May 14, 1986

[51] Int. Cl.[4] ..... H01R 4/66

[52] U.S. Cl. ..... 439/108; 439/607

[58] Field of Search ..... 339/14 R, 143 R

[56] References Cited

U.S. PATENT DOCUMENTS 3,366,918 1/1968 Johnson et al. ..... 339/143 R

*Primary Examiner*—Eugene F. Desmond

*Attorney, Agent, or Firm*—Faith F. Driscoll; John S. Solakian

[57] ABSTRACT

A pair of conductive ground clips each having a plurality of flexible fingers, are slid into an interference engagement with the ends of a flange of a D-shell connector. The ground clip equipped connector is held in a plastic connector housing which is latched to a conductive plate by flexible latching arms that are a part of the connector housing. As the connector housing is latched to the plate with the latching arms, flexible fingers on the clips touch the plate and flex making and maintaining a good electrical connection therewith. The ground clips maintain a proper electrical ground connection between the housing contained connector and the plate avoiding undesirable electrostatic discharge, electromagnetic interference, and radio-frequency interference.

6 Claims, 8 Drawing Figures

GROUNDING GASKET FOR D-SHELL CONNECTOR

BACKGROUND

1. Field of the Invention

The present invention pertains to electrical connector systems, and more particularly to a grounding apparatus for providing an improved ground connection to a conductive panel for a connector mounted in a housing that is latched to the panel.

2. Background of the Invention

In the prior art there are connector applications using D-shell connectors where it is required to ground the connector to a plate or chassis to which the connector is fastened. To accomplish both the grounding and fastening, screw fastening means are typically utilized in a manner well known in the art. One such prior art screw fastening arrangement is taught in U.S. Pat. No. 4,506,937, issued Mar. 26, 1985. Grounding problems sometimes exist with a D shell connector held within a connector cover that is latched by non-conductive, plastic flexible plastic arms to a plate, rather than by conductive means such as screws. Thus, the connector is not consistently firmly held against the plate to maintain the ground connection to the plate. This arises due to dimensional tolerances of the connector cover and latching arms. The resulting questionable ground connection may cause undesirable electrostatic discharge (ESD), electromagnetic interference (EMI) emanating from the connectors, or undesirable radio-frequency interference (RFI) generated within the equipment may "leak" at the point of grounding. Therefore, it is necessary to enhance positive grounding of a connector to a plate or chassis to which the connector and its connector cover are latched. Accordingly, there is a need in the art for apparatus to function with D shell connectors that are held in non-conductive covers, to enhance the electrical ground connection of the connector to a plate or chassis.

SUMMARY OF THE INVENTION

Accordingly, it is the primary object of the present invention to provide grounding apparatus for enhancing electrical grounding of a connector held in a connector cover to a conductive plate or chassis.

The object of the present invention is accomplished, by disposing a pair of specially designed conductive ground clips or gaskets between a D-shell connector and a conductive plate or chassis to which the connector is fastened via a connector housing. The ground clips attach to metallic flanges of the conductor and each clip includes a plurality of flexible contact fingers projecting from the surface of the ground clip in the direction of the plate. The contact fingers are flexed and make electrical contact with the plate when the ground clip is compressed between the connector and the plate when the connector housing holding the connector is latched to the conductive plate. As a result, even if the connector housing does not hold the connector firmly against the plate, electrical ground contact is maintained between the connector and the plate. Consequently, electro-static discharge (ESD) is minimized, and electro-magnetic interference (EMI) shielding and radio frequency interference (RFI) shielding are enhanced.

BRIEF DESCRIPTION OF THE DRAWINGS

The invention will be better understood upon reading the following detailed description in conjunction with the drawing in which.

DETAILED DESCRIPTION

Figure 1:
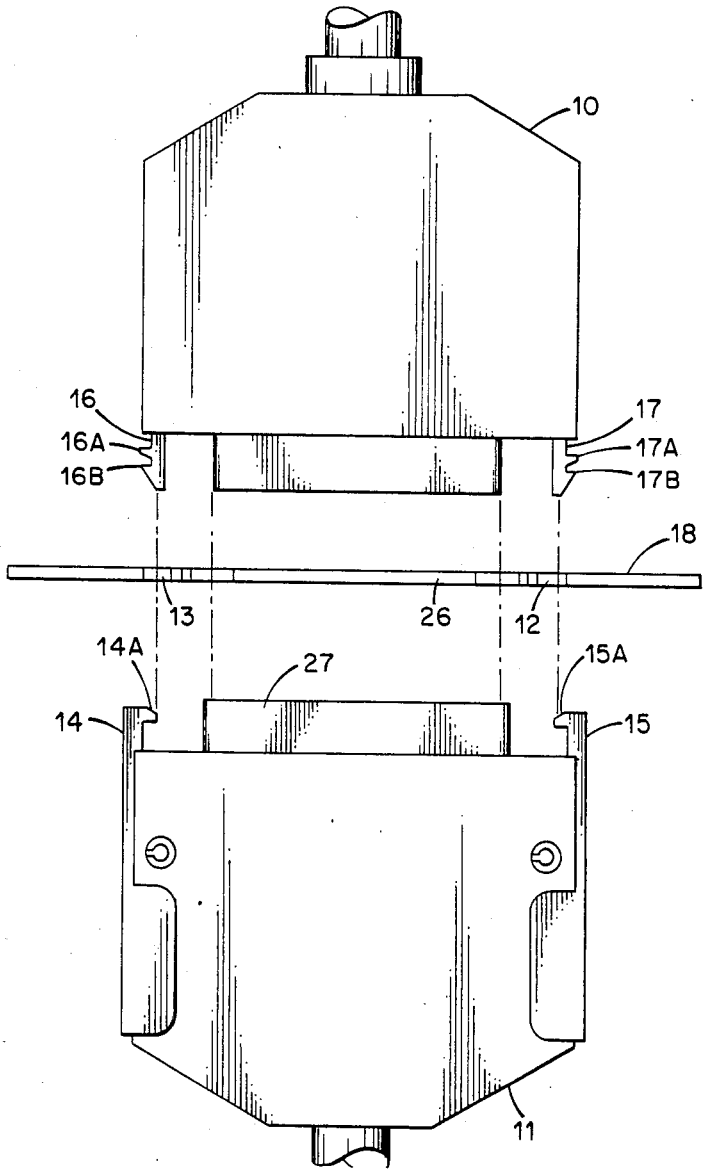
FIG. 1 illustrates an arrangement for latching a first connector in a connector cover to a second connector in another connector cover that is latched to a panel.

Referring to FIG. 1, therein is shown an arrangement for latching a connector cover with a connector therein to a panel. Connector cover 10 is provided with flexible arms 16 and 17 each having hooks 16A, 16B and 17A, 17B respectively. To fasten connector cover 10 to panel 18, the hook ends 16A and 17A of arms 16 and 17 pass through holes 12 and 13, and hooks 16A and 17a latch onto the edges of holes 12 and 13. Mating connector cover 11 is equipped with arms 14 and 15. Hook ends 14A and 15A of latching arms 14 and 15 snap and lock onto hooks 16B and 17B of arms 16 and 17 to lock connector covers 10 and 11 together with their electrical connectors mated.

An area that can use enhancement in the mated connector system shown in FIG. 1 relates to the electrical grounding between the connector in cover 10 and the panel or plate 18 to which connector cover 10 is latched. The manner of enhancement is the gasket or clip which is the subject of this invention and will now be described.

Referring to FIGS. 2A through 4, therein is shown a gasket grounding clip 19 constructed in accordance with the teachings of the present invention. Clip 19 is used to enhance or improve the elecrtrical ground connection between a D-shell connector 23 and a plate or chassis 18 with which the connector 23 is in contact due to its connector cover 10 being latched to plate 18. With the shape shown in FIG. 2A, clip 19 is designed to fit 9, 15, 25 and 37 pin sizes of standard male or female D-shell connectors. The clip can be easily changed to fit on other D-shell connectors that are of a different physical shape.

Figure 2A:
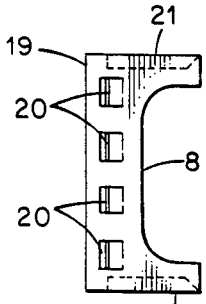
FIGS. 2A through 2C respectively illustrate front, side, and back views of a ground clip or gasket constructed according to the teachings of present invention.
Figure 2B:
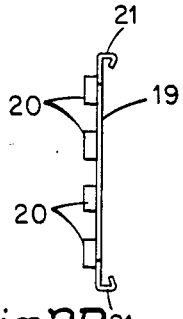
Figure 2C:
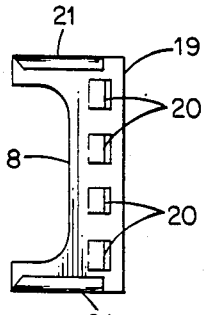
Figure 3A:
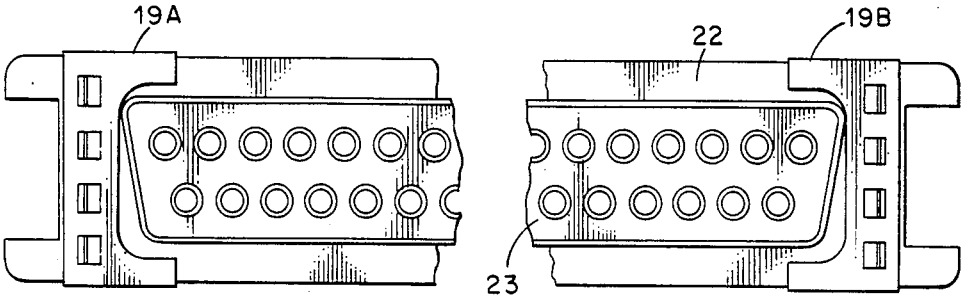
FIGS. 3A through 3C respectively illustrate front, side, and end views of a D-shell connector having a pair of ground clips mounted thereon according to the teachings of the present invention.

In FIGS. 2A through 2C, front, side, and back views respectively of the ground clip 19 are illustrated. Clip 19 includes four outwardly projecting fingers 20 which are each formed by stamping out a U-shaped piece from the body of the clip. Clip 19 also has a U-shaped cutout 8 as shown in FIGS. 2A and 2C to facilitate fitting the clip around the ends of the housing of the D shell connector as shown in FIG. 3A, and to control the positioning of the fingers or contacts 20 from the shell of the connector 23. Clip 19 also has two rolled edges 21 that facilitate mounting the clip on the connector flange 22 as particularly shown in FIG. 3C. The clip 19 and its fingers 20 must be made of a spring tempered material to allow flexing.

In the preferred embodiment of the invention, ground clip 19 is made from beryllium copper which is commonly used for spring contacts. Fingers 20 are formed to protrude as shown in FIG. 2B in order to make an electrical ground contact with the mounting plate (plate 18 in FIGS. 1 and 4) to which connector 23 is latched via connector cover 10. When clip 19 is installed and in use, fingers 20 are always in tension to maintain a good contact with plate 18. When tension on fingers 20 is eased, they do not stay in their compressed state and thereby maintain electrical contact. For fingers 20 are provided for contact redundancy and to make a gas tight (very good) electrical ground connection to plate 18 to which connector cover 10 is latched.

Clip 19 is tin plated to enhance its contact capabilities and to inhibit corrosion that will degrade the resistance of the electrical contact made by fingers 20. The flange 22 of D-type connectors must be conductive in order to work with the present invention. Typically, flange 22 is iridited or tin plated to ensure a good contact between the clips 19A and 19B and the flange 22. It is preferred that flange 22 of connector 23, plate 18 to which connector housing 10 is fastened, as well as clip 19 be tin plated. Tin plating on all the parts in the electrical ground path eliminates any resistance problems and eliminates electolytic action caused by dissimilar metals.

In FIG. 2B, a side view of the ground clip 19 better illustrates the four fingers 20 projecting outwardly from the body of the clip. In addition, the rolled edges 21 are better illustrated. The spacing of the gap of the rolled edge is 0.020 inches while the thickness of flange 22 is 0.030 inches. When a clip 19 is installed on flange 22, the gap of its rolled edge is forced open. Due to clip 19 being fabricated of a spring tempered material, it thereby forms a gas tight (very good) seal to flange 22. FIG. 2C is a back view of the ground clip 19 which illustrates its rolled edges 21.

Figure 3B:
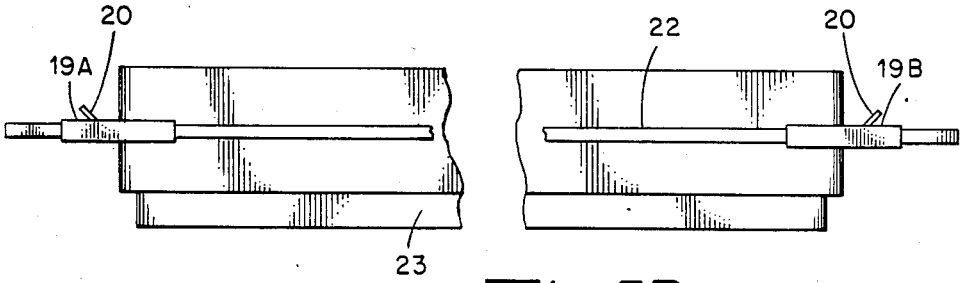
Figure 3C:
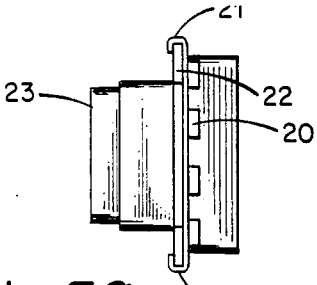

Referring to FIGS. 3A through 3C, a front, side, and end view of either a male or female connector 23 with two ground clips 19A and 19B attached thereto is illustrated. It can particularly be seen in FIG. 3A how the U-shaped open end 8 of clips 19A and 19B fits around either end of the connector shell. The position and shape of cutout 8 also allows alignment of the fingers 20 to plate 18 and the cutouts therethrough.

In FIG. 3A, a top view of a connector 23 is illustrated. Two ground clips 19A and 19B are shown installed by friction fit on the flange 22 of connector 23. Rolled edges 21, shown best in FIG. 3C, accomplish a spring type friction fit electrical contact to flange 22. A tool may be used to facilitate installing ground clips 19A and 19B onto flange 22.

FIG. 3B illustrates a side view of connector 23 with ground clips 19A and 19B friction fit on the ends of connector flange 22. Also shown are springy fingers 20 which make electrical contact with a plate 18 (not shown in FIG. 3, but shown in FIG. 4). The fingers 20 extend in the direction of the mounting plate. In final installation, only the connector 23 in a connector housing 10 latched to a panel 18 has clips 19A and 19B attached thereto. When cover 10 is latched to panel 18, fingers 20 of clips 19A and 19B are in contact with the tin plated plate 18 and are deflected to make a gas tight seal therewith and adjust for variations in the tolerances of the connector cover 10 and its arms 16 and 17.

FIG. 3C illustrates an end view of a connector 23 with one of the ground clips 19 interference fitted onto flange 22 via rolled edges 21. It can be seen that the four fingers 20 on the clip 19, project outwardly from the body of ground clip 19. The fingers 20 are flexible, as previously described, and when they are compressed against a solid surface, such as the plate 18, fingers 20 flex to make and maintain a good ground connection to plate 18.

Figure 4:
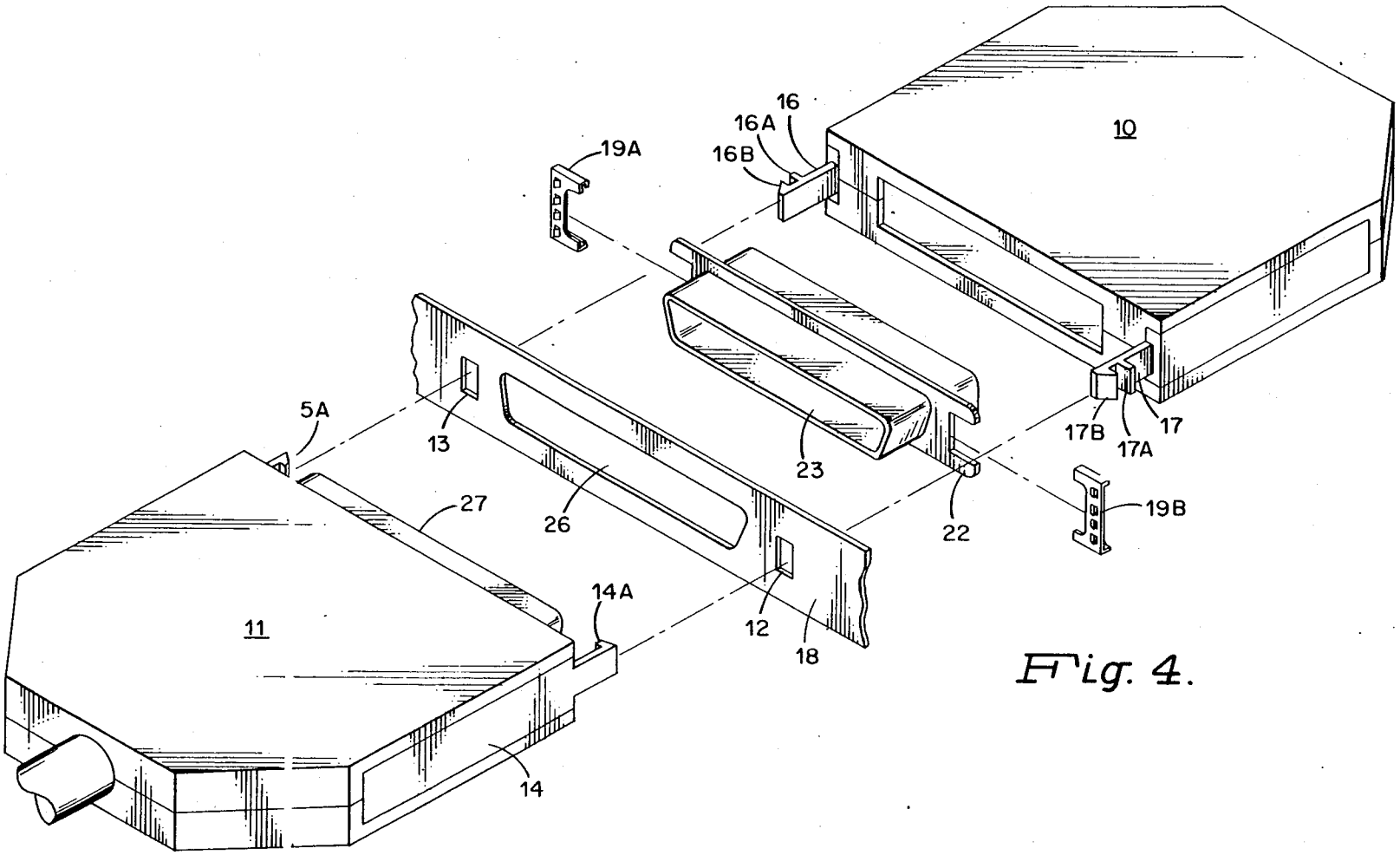
FIG. 4 illustrates a break away three-dimensional view of a connector having attached thereto a pair of ground clips, and the connector mounted in a connector housing that is latched to a panel.

Referring to FIG. 4, therein is shown a three-dimensional perspective view of mated connector covers 10 and 11 shown in FIG. 1. The ground clips 19A and 19B are installed on the ends of flange 22 of connector 23 as previously described, and shown in greater detail in FIG. 3A. Connector 23 with ground clips 19A and 19B thereon is placed up against plate 18. The front of connector 23 passes through cutout 26 through plate 18. As connector cover 10 is latched to plate 18 as previously described with reference to FIG. 1, ground clips 19A and 19B are compressed between flange 22 and plate 18. Compressing the fingers 20 on the clips makes a good electrical ground connection between flange 22, clips 19A and 19B, and plate 18.

It would be obvious to those skilled in the art that the invention may be varied in many ways without departing from the spirit and scope of the invention.

What is claimed is:

1. Apparatus for establishing and maintaining an electrical ground connection between an electrical connector with a flange contained within a non-conductive cover and a conductive plate to which the covered connector is fastened by non-conductive latching means, said ground connection apparatus comprising:

an electrically conductive body portion having a predetermined shape and top and bottom edges, said top and bottom edges, each having curled member means, said curled member means being shaped to be slidably engaged in an interference fit with said connector flange to attach said ground connection apparatus to said connector, and a plurality of electrically conductive, flexible finger means projecting outwardly from said body portion and outwardly from said connector when said ground connection apparatus is slidably attached to said connector, said finger means contacting said conductive plate and flexing when said connector with said ground connection apparatus attached thereto is fastened to said conductive plate, said flexed finger means maintaining an electrical ground connection between said connector and said conductive plate when said connector is not firmly held against said plate.

2. The apparatus in accordance with claim 1 wherein said grounding apparatus is made of tin plate beryllium copper.

3. Apparatus for use in establishing and maintaining proper electrical ground connection between a connector housed in a non-conductive cover and having a conductive flange mounted thereon, said cover including said conductor being attachable to a conductive panel by non-conductive latching arms, said apparatus comprising:

a number of electrically conductive clips, each clip having a rectangular-shaped body with a U-shaped open end, each said clip having top and bottom edges curled inwardly by a predetermined amount to slidably attach to one end of said flange so that said open end fits around an end of said connector, and said body having a plurality of U-shaped cutouts bent to protrude outwardly from said body as finger-like projections, said projections being positioned for contacting the surface of said panel and flexing when said covered connector and attached clips are fastened to said panel by said latching arms, said projections being flexed to maintain good electrical ground connection between said connector and said panel notwithstanding differences in tolerances between said cover and latching arms which may prevent said connector from being firmly held against said panel.

4. The apparatus of claim 3 wherein said clips are made of spring tempered material and said number of clips is two.

5. The apparatus of claim 3 wherein said plurality of finger-like projections are arranged in a column and the number of said projections are sufficient to ensure good electrical contact.

6. The apparatus of claim 3 wherein said predetermined amount of inward curl provides a gap which is less than said flange forming a tight friction fit with said flange and providing a good electrical connection when slidably attached thereto.

* * * * *